US010888751B1

(12) United States Patent
Frederickson et al.

(10) Patent No.: US 10,888,751 B1
(45) Date of Patent: Jan. 12, 2021

(54) GOLF CLUB HEAD WITH INTERCHANGEABLE WEIGHT COMPONENTS

(71) Applicant: Callaway Golf Company, Carlsbad, CA (US)

(72) Inventors: Austin L. Frederickson, San Diego, CA (US); Timothy G. Scott, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/808,889

(22) Filed: Mar. 4, 2020

(51) Int. Cl.
*A63B 53/06* (2015.01)
*A63B 53/04* (2015.01)
*A63B 60/02* (2015.01)

(52) U.S. Cl.
CPC ..... *A63B 53/06* (2013.01); *A63B 53/0466* (2013.01); *A63B 60/02* (2015.10); *A63B 2053/0491* (2013.01)

(58) Field of Classification Search
CPC ..... A63B 53/06; A63B 53/0466; A63B 60/02; A63B 2053/0491
See application file for complete search history.

(56) References Cited

U.S. PATENT DOCUMENTS

| | | | | |
|---|---|---|---|---|
| 2,155,830 | A * | 4/1939 | Howard | A63B 53/06 473/246 |
| 9,205,312 | B2 * | 12/2015 | Zimmerman | A63B 60/00 |
| 9,498,686 | B2 * | 11/2016 | Breier | A63B 53/0466 |
| 9,636,556 | B2 * | 5/2017 | Beck | A63B 71/0622 |
| 9,968,833 | B2 * | 5/2018 | Breier | A63B 60/52 |
| 9,975,019 | B2 * | 5/2018 | Frame | A63B 53/06 |
| 2006/0122004 | A1 * | 6/2006 | Chen | A63B 53/0466 473/335 |
| 2014/0080629 | A1 * | 3/2014 | Sargent | A63B 60/00 473/336 |
| 2015/0297961 | A1 * | 10/2015 | Voshall | A63B 53/06 473/335 |
| 2019/0060718 | A1 * | 2/2019 | Milleman | A63B 53/0466 |

* cited by examiner

*Primary Examiner* — Stephen L Blau
(74) *Attorney, Agent, or Firm* — Rebecca Hanovice; Michael Catania; Sonia Lari

(57) ABSTRACT

A golf club head comprising a channel, a slidable weight that can be reversibly fixed at any point within the channel, and a pocket to store a portion of the slidable weight is disclosed herein. The slidable weight comprises first and second weight plates, each made of materials having different densities, a lightweight retainer, a screw, and a nut. The second weight plate has the same dimensions as, and is interchangeable with, the first weight plate and is disposed in a pocket in the sole proximate the face of the golf club head. The retainer and nut have snap-fit features that allow them to remain loosely attached to one another during adjustment of the assembly and when one weight plate is swapped with the other.

20 Claims, 3 Drawing Sheets

GOLF CLUB HEAD WITH INTERCHANGEABLE WEIGHT COMPONENTS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a weight for a golf club head that can be adjusted along a continuous channel and that has interchangeable components that can be stored at different locations on the golf club head.

Description of the Related Art

The ability to adjust center of gravity location and weight in the head of driving clubs is useful for controlling performance of the golf club. The prior art includes several different solutions for adjustable weighting, including movable or slidable weights. While increasing the number of positions where a weight can be moved may be desirable for a golfer, the structures necessary to support these positions (ribs, support struts, etc.) can use up discretionary mass, interfere with the sound of the club head upon impact with a golf ball, and/or interfere with swing by interacting with turf during use. The structure of the weight itself also complicates the problem, as the parts used to create a movable or slidable weight are typically made from monolithic metal pieces. Therefore, there is a need for an adjustable weighting mechanism with a structural support system that does not use up significant discretionary mass or unnecessarily affect sound.

BRIEF SUMMARY OF THE INVENTION

One aspect of the present invention is a golf club head comprising a body comprising a sole, a heel side, a toe side, a face portion, a rear side, a pocket, and a channel, and a weight assembly comprising, a first weight plate composed of a first material having a first density, the first weight plate comprising a first through opening and a first flange, a second weight plate composed of a second material having a second density that is different from the first density, the second weight plate comprising a second through opening and a second flange, a screw comprising a head portion and an threaded extension portion, a retainer composed of a third material having a third density that is less than the first and second densities, the retainer comprising a retainer body, a shallow recess sized to receive either of the first and second weight plates, a third through opening, and first and second extensions extending perpendicularly from the retainer body, and a base portion comprising a threaded opening sized to receive the threaded extension portion, wherein the pocket is sized to receive either of the first and second plates, wherein the channel comprises a first wall, a second wall, a floor, and at least one rail extending from one of the first wall and the second wall, wherein the weight assembly is disposed within and movable to any location in the channel, wherein the base portion and at least one of the retainer, the first plate, and the second plate sandwiches a portion of the at one least rail, wherein the threaded extension portion of the screw extends through one of the first and second through openings, through the third through opening, and engages the threaded opening, and wherein tightening the screw reversibly fixes the weight assembly to the at least one rail.

In some embodiments, the base portion may comprise a first side with a first protrusion and a second side with a second protrusion, the first extension may comprise a first snap feature, the second extension may comprise a second snap feature, and the first and second snap features may engage the first and second protrusions, respectively, to reversibly attach the retainer to the base portion. In other embodiments, the retainer and one of the first and second plates may sandwich the at least one rail. In still other embodiments the first plate may have a first color, the second plate may have a second color, and the first color may contrast with the second color. In any of the embodiments, each of the first plate and the second plate may have a polygonal shape. In any of the embodiments, the first plate may have the same dimensions as the second plate. In another embodiment, the body may comprise a shelf proximate the channel, and at least a portion of one of the first plate and the second plate may rest on the shelf when it is engaged with the retainer. In other embodiments, each of the channel and the pocket may be disposed in the sole, and the pocket may be located proximate the face portion. In any embodiment, the channel is disposed proximate the rear side of the body. In yet another embodiment, when either of the first plate and the second plate is disposed within the pocket, an upper surface of the first plate or the second plate may be flush with an exterior surface of the body.

Another aspect of the present invention is a driver-type club head comprising a metal alloy body comprising a sole, a heel side, a toe side, a face portion, a rear side, an upper opening, a pocket, and a channel, a composite crown affixed to the body to cover the upper opening, and a slidable weight assembly comprising a first weight plate composed of a tungsten alloy, the first weight plate comprising a first through opening and a first flange, a second weight plate composed of a second material selected from the group consisting of steel and aluminum alloy, the second weight plate comprising a second through opening and a second flange, a retainer composed of a third material selected from the group consisting of plastic and carbon composite, the retainer comprising a retainer body, a retainer recess sized to receive either of the first and second weight plates, a third through opening, and first and second extensions extending perpendicularly from a bottom surface of the retainer body, a first screw comprising a head portion and an threaded extension portion, and a base portion comprising a first threaded opening, a first side with a first protrusion, and a second side with a second protrusion, wherein the pocket is sized to receive either of the first and second plates, wherein the channel comprises a first wall, a second wall, a floor, a first rail extending from the first wall, and a second rail extending from the second wall, wherein the first extension comprises a first snap feature and the second extension comprises a second snap feature, wherein the first and second snap features engage the first and second protrusions, respectively, to reversibly attach the retainer to the base portion, wherein the base portion, the retainer, and one of the first plate, and the second plate sandwiches a portion of at least one of the first and second rails, wherein the threaded extension portion of the first screw extends through one of the first and second through openings, through the third through opening, and engages the threaded opening, and wherein tightening the first screw reversibly fixes the weight assembly to the rails.

In some embodiments, the first side of the base portion may be disposed opposite the second side of the base portion. In other embodiments, the pocket may be disposed within the sole proximate the face, and the channel may be disposed within the sole proximate the rear side. In any of the embodiments, one of the first and second plates may be disposed within the retainer, and the other of the first and second plates may be disposed within the pocket. In a further embodiment, exchanging the first and second plates within the pocket and the channel may change the mass properties of the golf club head. In another embodiment, moving the slidable weight assembly within the channel may change the mass properties of the golf club head. In yet another embodiment, at least one of the first and second plates may be hollow. In another embodiment, the golf club head may further comprise a second screw, the pocket may comprise a second threaded opening, and the second screw may affix one of the first and second plates to the pocket by engaging with the second threaded opening. In yet another embodiment, each of the first plate, the second plate, and the pocket may have a polygonal shape, which may be triangular.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
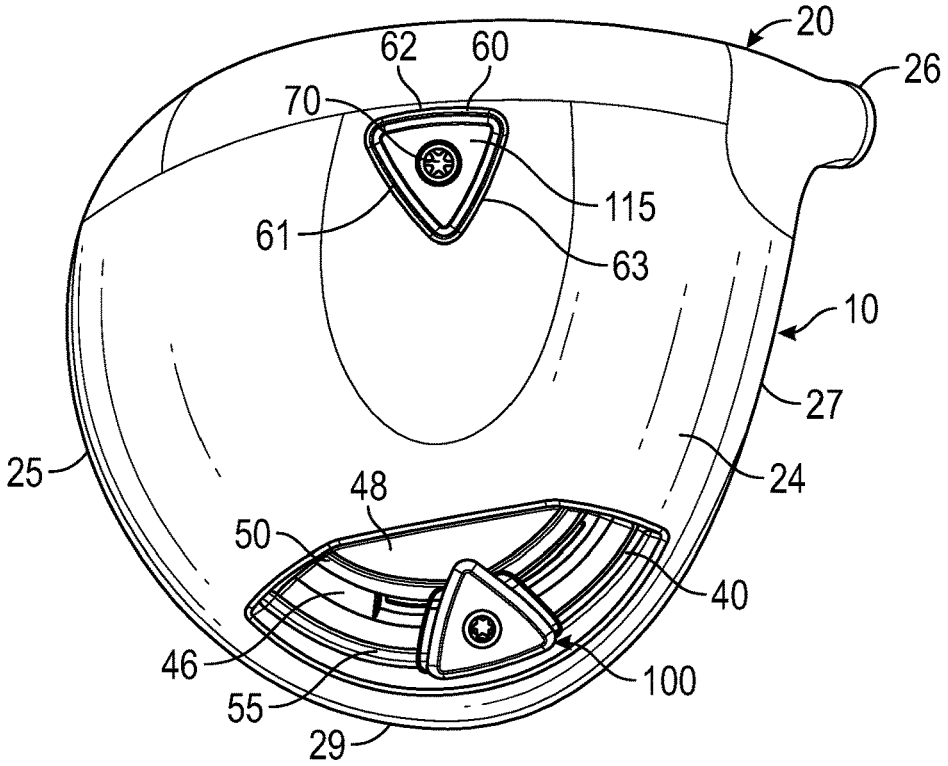
FIG. 1 is a sole elevational view of a golf club head of the present invention.

The design approaches described herein are based on a construction used in a driver head characterized by a composite crown adhesively bonded to a cast titanium body. However, the weighting embodiments disclosed herein can be used with other constructions, including all titanium, all composite, and a composite body with metal face cup. The invention disclosed herein builds and improves upon the golf club head disclosed in U.S. Pat. No. 9,675,856, the disclosure of which is hereby incorporated by reference in its entirety herein. While the structure disclosed in U.S. Pat. No. 9,675,856 is useful and desirable, the weight disclosed therein has excessive mass due to the requirement that it be capable of fitting within different structures within the golf club head, and the overall movable weight system has room for optimization. The weight assembly 100 of the current invention and the structures of the golf club head 10 that receive the weight assembly 100 represent an improvement over this art.

A preferred embodiment of the present invention is shown in FIGS. 1-5. The golf club head 10 comprises a metal body 20 with a face 22, a sole 24, a heel side 25, a hosel 26, a toe side 27, an upper opening 28, and a rear side 29, and a composite crown 30 that is adhered to the body 20 and covers the upper opening 28. A channel 40 is disposed at a rear side 29 of the sole 24, near an edge region 32 where the crown 30 connects to the sole 24, but may, in alternative embodiments, be disposed in the sole 24 proximate the face 22, within a side or ribbon portion of the golf club head 10, or in the crown 30. The channel 40, which preferably has any or all of the characteristics disclosed in U.S. Pat. No. 9,675,856, extends from the heel side 25 to the toe side 27 of the rear side 29, and has first and second side walls 42, 44, a floor 46, and a pair of rails 50, 55 extending from the side walls 42, 44 and across at least halfway across the length of the channel 40. A shelf 48 is disposed proximate the side wall 42 closest to the face 22 and is recessed with respect to the sole 24 to allow for greater ease of access to the channel 40.

Figure 2:
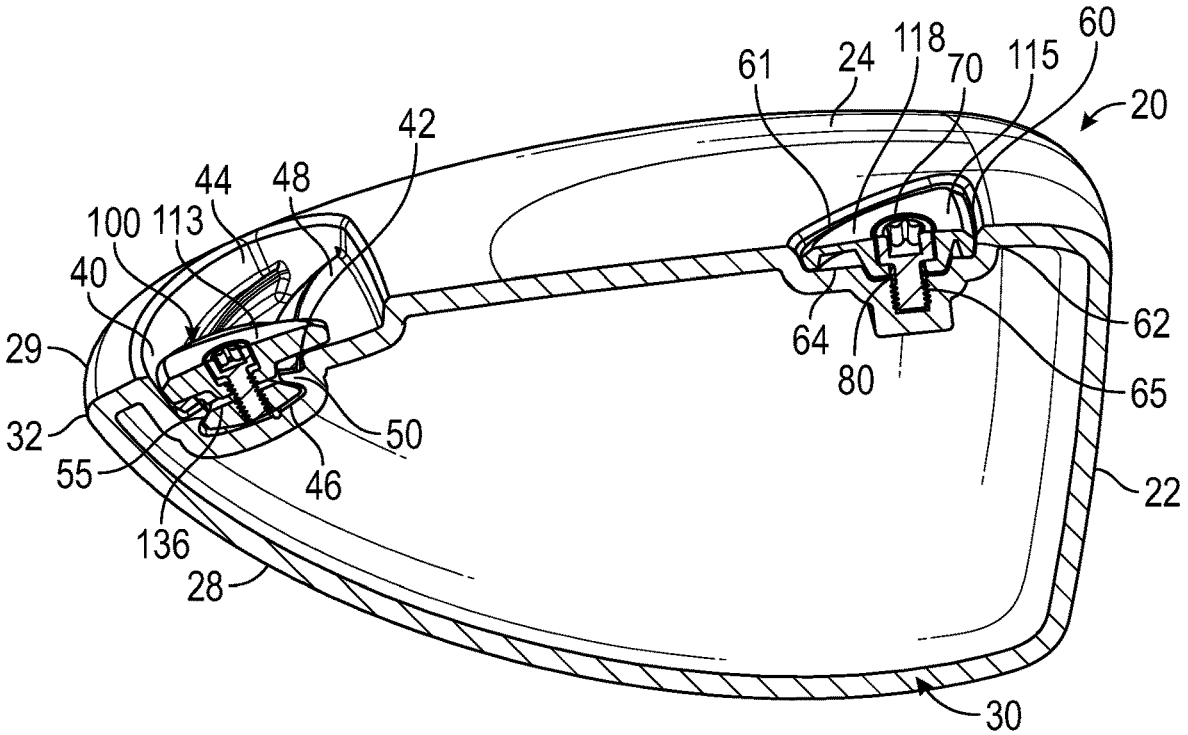
FIG. 2 is a cross-sectional view of the embodiment shown in FIG. 1 along lines 2-2.
Figure 3:
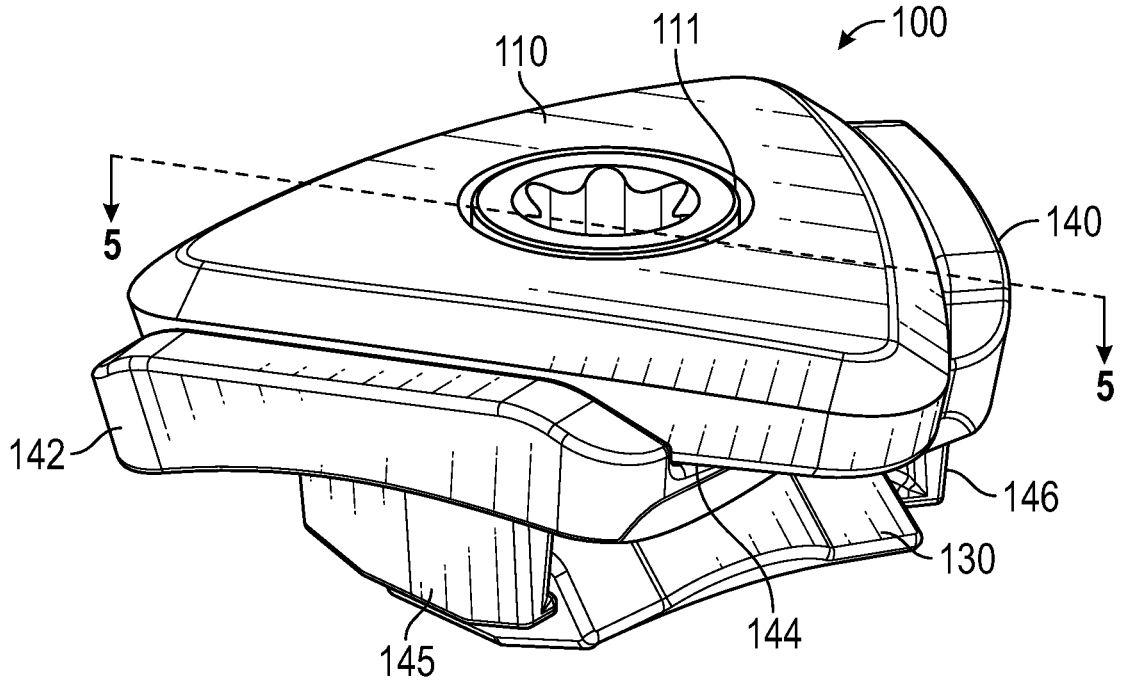
FIG. 3 is a top perspective view of the slidable weight shown in FIG. 1.
Figure 4:
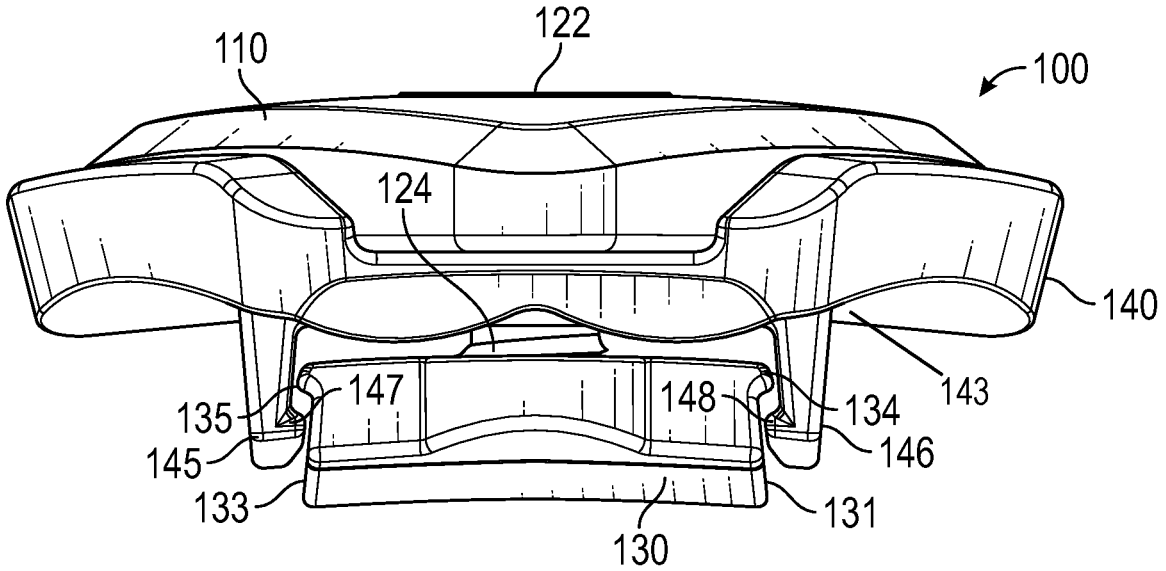
FIG. 4 is a side plan view of the slidable weight shown in FIG. 3.

The golf club head 10 also includes a shallow pocket 60, which preferably is disposed in a central location of the sole 24 proximate the face 22. The pocket 60, which can have any shape, such as rectangular (as shown in U.S. Pat. No. 9,675,856), square, or triangular (as shown in the Figures), comprises a plurality of walls 61, 62, 63, a floor 64, and a threaded bore 65, and is sized to receive each of the plates 110, 115 of the weight assembly 100, though not both at the same time. A screw 70 is also associated with the pocket 60 to extend into whichever plate 110, 115 is selected to be disposed within the pocket 60 (if any) and engage with the threaded bore 65. As shown in FIG. 2, the screw 70 can include an o-ring 80 to keep the screw 70 from disengaging from the plate 115, or the plate 115 may include a threaded portion or gasket feature to retain the screw 70.

The slidable weight assembly 100 of the present invention comprises first and second weight plates 110, 115, each made of different materials having different densities, and each having a through opening 111, 116 with a flange 112, 117. The plates 110, 115 have the same dimensions as each other, but may be decorated distinctively, with different patterns, colors, or textures from one another. The plates 110, 115 may also have different internal structures, with one being cored out, hollow, or otherwise structurally lightened. One of the plates 115 fits and is reversibly retained within the pocket 60 proximate the face 22, as shown in FIGS. 1 and 2. The other plate 110 is affixed to the rest of the slidable weight assembly 100, which also includes a screw 120 with a head portion 122 and a threaded extension 124, a base portion or nut 130 with a threaded opening 132 and a pair of small protrusions 134, 135, and a retainer 140. The retainer 140 includes a body 142 with a shallow recess 144 sized to receive each of the first and second weight plates 110, 115 (but not at the same time), a through opening 141, and a pair of extensions 145, 146 with snap features 147, 148 extending approximately perpendicular from a bottom surface 143 of the body 142. The extensions 145, 146 are sized to fit around opposite sides 131, 133 of the nut 130 so that the snap features 147, 148 engage with the protrusions 134, 135 to reversibly affix the retainer 140 to the nut 130. The retainer 140 is preferably composed of a material having a lower density than that of the material of the plates 110, 115, thereby reducing the weight of the assembly 100 in comparison with prior art designs. In addition to reducing the overall mass of the assembly 100, the retainer 140 allows the plate 110, 115 to have a more simplified geometry, without any complicated retention structures, compared with prior art assemblies, thereby requiring the pocket 60 to have fewer complicated support features.

A golfer can adjust the mass properties of the golf club head 10 of the present invention by choosing the plate 110, 115 having the desired mass properties and/or aesthetic surface designs that he or she wishes to engage with the rest of the slidable weight assembly 100. The unselected plate 110, 115 can be affixed within the pocket 60 with the screw 70, or left off the golf club head 10 entirely. The benefit of the weight assembly 100 disclosed herein lies in the fact that it does not need to be completely disassembled while a golfer is selecting or moving the plate 110, 115. Instead, the nut 130 is placed in the channel 40 so that the rails 50, 55 extend partially over the top surface 136 of the nut 130, and the protrusions 134, 135 on the sides 131, 133 are exposed. The retainer 140 is then placed atop the nut 130 so that the extensions 145, 146 cover the exposed sides of the nut 130 and the snap features 147, 148 engage with the protrusions 134, 135, thereby reversibly, and loosely, affixing the retainer 140 to the nut 130 while allowing enough space to exist between the retainer body 142 and the nut 130 so the partially assembled weight assembly 100 can easily slide along the rails 50, 55 without falling out of the channel 40.

Figure 5:
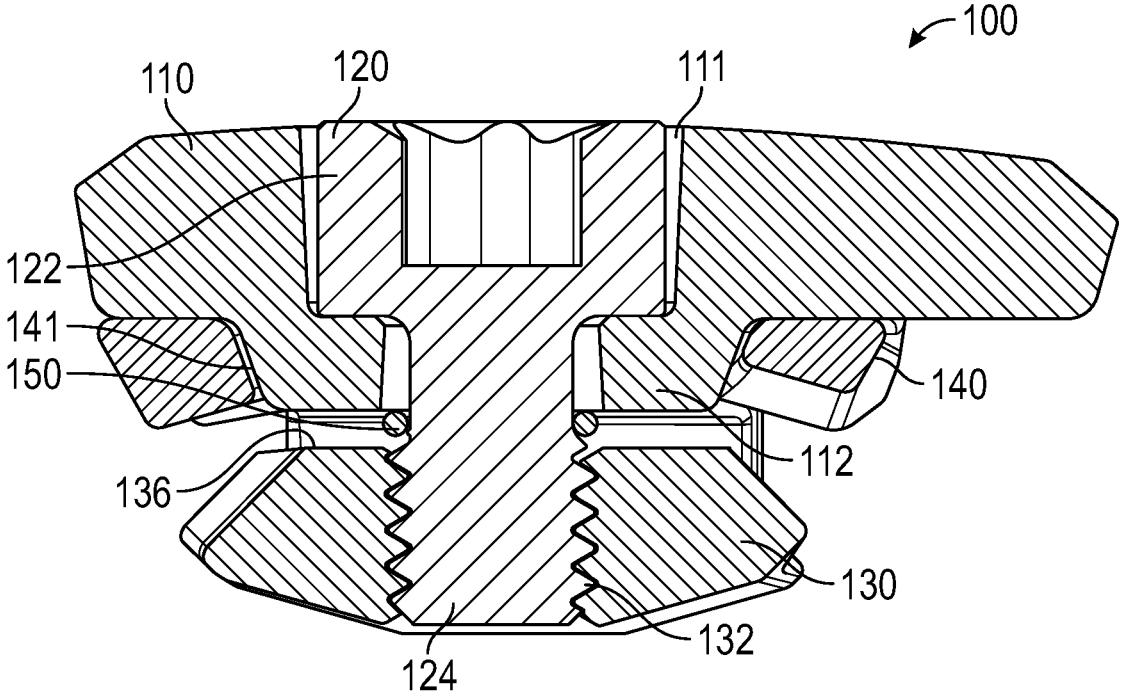
FIG. 5 is a cross-sectional view of the slidable weight shown in FIG. 3 along lines 5-5.

Once the user selects the preferred plate 110, the plate 110 is placed within the recess 144 of the retainer 140 and the screw 120 is engaged with the rest of the assembly 100; the threaded extension 124 extends through the opening 111 of the plate 110, the opening 141 in the retainer 140, and engages with the threaded opening 132 in the nut 130. The plate 110 preferably extends onto the shelf 48 of the channel 40; this improves accessibility to the assembly 100, and gives the plate 110 a larger area to slide along. As shown in FIG. 5, an o-ring 150 can be attached to the threaded extension 124 of the screw 120 to prevent it from disengaging from the plate 110. The golfer can slide the weight assembly 100 to a desired location within the channel 40, with the rails 50, 55 extending into a gap between the retainer 140 and the nut 130. Once the golfer selects a desired location, she can tighten the screw 120 so that the head portion 122 abuts the flange 112 and the extension portion fully engages with the threaded opening 132, thereby causing the retainer 140 and nut 130 clamp the rails 50, 55 between them, and reversibly trapping the plate 110 and the retainer 140 together between the nut 130 and the head portion 122.

As shown in FIG. 2, when the plates 110, 115 are engaged with the body within the channel 40 and pocket 60, their upper surfaces 113, 118 are flush with an exterior surface 21 of the sole 24 to avoid interfering with the turf when the golf club head 10 is in use.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a sole, a heel side, a toe side, a face portion, a rear side, a pocket, and a channel; and a weight assembly comprising;

a first weight plate composed of a first material having a first density, the first weight plate comprising a first through opening and a first flange;

a second weight plate composed of a second material having a second density that is different from the first density, the second weight plate comprising a second through opening and a second flange;

a screw comprising a head portion and an threaded extension portion;

a retainer composed of a third material having a third density that is less than the first and second densities, the retainer comprising a retainer body, a shallow recess sized to receive either of the first and second weight plates, a third through opening, and first and second extensions extending from a lower surface of the retainer body; and a base portion comprising a threaded opening sized to receive the threaded extension portion, wherein the pocket is sized to receive either of the first and second plates, wherein the channel comprises a first wall, a second wall, a floor, and at least one rail extending from one of the first wall and the second wall, wherein the weight assembly is disposed within and movable to any location in the channel, wherein the base portion and at least one of the retainer, the first plate, and the second plate sandwiches a portion of the at one least rail, wherein the threaded extension portion of the screw extends through one of the first and second through openings, through the third through opening, and engages the threaded opening, and wherein tightening the screw reversibly fixes the weight assembly to the at least one rail.

2. The golf club head of claim 1, wherein the base portion comprises a first side with a first protrusion and a second side with a second protrusion, wherein the first extension comprises a first snap feature, wherein the second extension comprises a second snap feature, and wherein the first and second snap features engage the first and second protrusions, respectively, to reversibly attach the retainer to the base portion.

3. The golf club head of claim 1, wherein the base portion and one of the first and second plates sandwiches the at least one rail.

4. The golf club head of claim 1, wherein the first plate has a first color, wherein the second plate has a second color, and wherein the first color contrasts with the second color.

5. The golf club head of claim 1, wherein each of the first plate and the second plate has a polygonal shape.

6. The golf club head of claim 1, wherein the first plate has the same dimensions as the second plate.

7. The golf club head of claim 1, further comprising a shelf in the body proximate the channel, wherein at least a portion of one of the first plate and the second plate rests on the shelf when it is engaged with the retainer.

8. The golf club head of claim 1, wherein each of the channel and the pocket is disposed in the sole, and wherein the pocket is located proximate the face portion.

9. The golf club head of claim 1, wherein the channel is disposed proximate the rear side of the body.

10. The golf club head of claim 1, wherein when either of the first plate and the second plate is disposed within the pocket, an upper surface of the first plate or the second plate is flush with an exterior surface of the body.

11. A driver-type club head comprising:

a metal alloy body comprising a sole, a heel side, a toe side, a face portion, a rear side, an upper opening, a pocket, and a channel;

a composite crown affixed to the body to cover the upper opening; and a slidable weight assembly comprising;

a first weight plate composed of a tungsten alloy, the first weight plate comprising a first through opening and a first flange;

a second weight plate composed of a second material selected from the group consisting of steel and aluminum alloy, the second weight plate comprising a second through opening and a second flange;

a retainer composed of a third material selected from the group consisting of plastic and carbon composite, the retainer comprising a retainer body, a retainer recess sized to receive either of the first and second weight plates, a third through opening, and first and second extensions extending perpendicularly from a bottom surface of the retainer body;

a first screw comprising a head portion and an threaded extension portion; and a base portion comprising a first threaded opening, a first side with a first protrusion, and a second side with a second protrusion, wherein the pocket is sized to receive either of the first and second plates, wherein the channel comprises a first wall, a second wall, a floor, a first rail extending from the first wall, and a second rail extending from the second wall, wherein the first extension comprises a first snap feature and the second extension comprises a second snap feature, wherein the first and second snap features engage the first and second protrusions, respectively, to reversibly attach the retainer to the base portion, wherein the base portion, the retainer, and one of the first plate, and the second plate sandwiches a portion of at least one of the first and second rails, wherein the threaded extension portion of the first screw extends through one of the first and second through openings, through the third through opening, and engages the threaded opening, and wherein tightening the first screw reversibly fixes the weight assembly to the rails.

12. The driver-type golf club head of claim 11, wherein the first side of the base portion is disposed opposite the second side of the base portion.

13. The driver-type golf club head of claim 11, wherein the pocket is disposed within the sole proximate the face, and wherein the channel is disposed within the sole proximate the rear side.

14. The driver-type golf club head of claim 11, wherein one of the first and second plates is disposed within the retainer, and the other of the first and second plates is disposed within the pocket.

15. The driver-type golf club head of claim 14, wherein exchanging the first and second plates within the pocket and the channel changes the mass properties of the golf club head.

16. The driver-type golf club head of claim 11, wherein moving the slidable weight assembly within the channel changes the mass properties of the golf club head.

17. The driver-type golf club head of claim 11, wherein at least one of the first and second plates is hollow.

18. The driver-type golf club head of claim 11, further comprising a second screw, wherein the pocket comprises a second threaded opening, and wherein the second screw affixes one of the first and second plates to the pocket by engaging with the second threaded opening.

19. The driver-type golf club head of claim 11, wherein each of the first plate, the second plate, and the pocket has a polygonal shape.

20. The driver-type golf club head of claim 19, wherein the polygonal shape is triangular.

* * * * *